US005486006A

United States Patent [19]

Bruno et al.

[11] Patent Number: 5,486,006

[45] Date of Patent: Jan. 23, 1996

[54] MUSIC QUIZ GAME FOR AMUSEMENT

[76] Inventors: Michael Bruno, 2570 Madison Rd. Ste. #13, Cincinnati, Ohio 45208; Andy Curran, 1063 Bruce Ave., Cincinnati, Ohio 45230

[21] Appl. No.: 154,950

[22] Filed: Nov. 19, 1993

[51] Int. Cl.[6] ..... A63F 1/00

[52] U.S. Cl. ..... 273/301

[58] Field of Search ..... 273/243, 292, 273/301, 430, 431, 432

[56] References Cited

U.S. PATENT DOCUMENTS

| | | | |
|---|---|---|---|
| 4,326,711 | 4/1982 | Giallombardo | 273/431 |
| 4,940,239 | 6/1990 | Tuttle | 273/243 |
| 5,048,842 | 9/1991 | Proctor | 273/248 |
| 5,083,794 | 1/1992 | Santagata | 273/249 |
| 5,121,928 | 6/1992 | Salerno-Sonneberg | 273/431 X |
| 5,308,079 | 5/1994 | Dreznick et al. | 273/432 X |

FOREIGN PATENT DOCUMENTS

| | | | |
|---|---|---|---|
| 2219217 | 12/1989 | United Kingdom | 273/249 |

*Primary Examiner*—William E. Stoll
*Attorney, Agent, or Firm*—Wood, Herron & Evans

[57] ABSTRACT

The present invention is a question-and-answer format quiz game having a music theme. The quiz game is based upon questions wherein a song title and year are identified and a player is requested to identify the artist that performed the song within a predetermined time period. In addition to temporal categories for the questions, such as by decade, there may be categories for different types of music, such as pop, country, R&B, etc. The temporal and music categories are randomly selected by rolling dice.

11 Claims, 1 Drawing Sheet

MUSIC QUIZ GAME FOR AMUSEMENT

FIELD OF THE INVENTION

The present invention is directed to a question-and-answer format quiz game, and more particularly to such a quiz game having a music theme.

BACKGROUND OF THE INVENTION

There are a wide variety of both play-at-home and broadcast (including radio and television) quiz games that have a question-and-answer format. For example, TRIVIAL PURSUIT™ is one play-at-home type game and JEOPARDY™ is a broadcast-type game show which also has a play-at-home version. In addition, there are question-and-answer format games which have a music related theme, such as NAME THAT TUNE™. In this latter game, a short segment of a musical tune or song is played and a game player is asked to identify the name of the tune and/or the recording artist thereof.

While each of the above-identified and other known question-and-answer format games provide entertainment to game players and persons watching, there has been a need, particularly in the area of music-related games, for one which is structured to enhance the players' enjoyment and success in playing the game. Furthermore, a question-and-answer format game which utilizes music-related questions categorized by year or decade, as well as by type of music, has been needed. The quiz game of the present invention as described hereinbelow satisfies these and other needs.

BRIEF DESCRIPTION OF THE INVENTION

Figure 1:
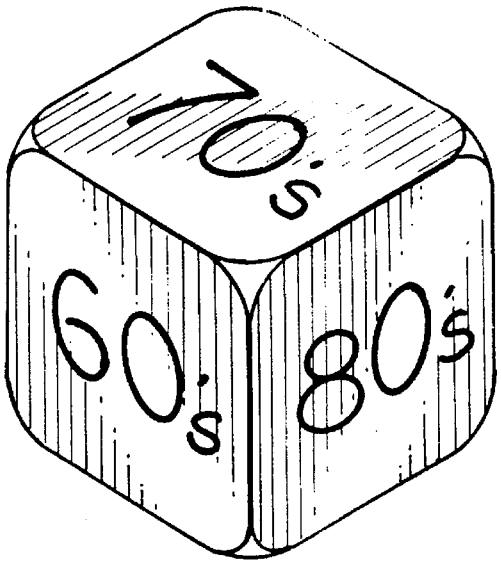
Figure 2:
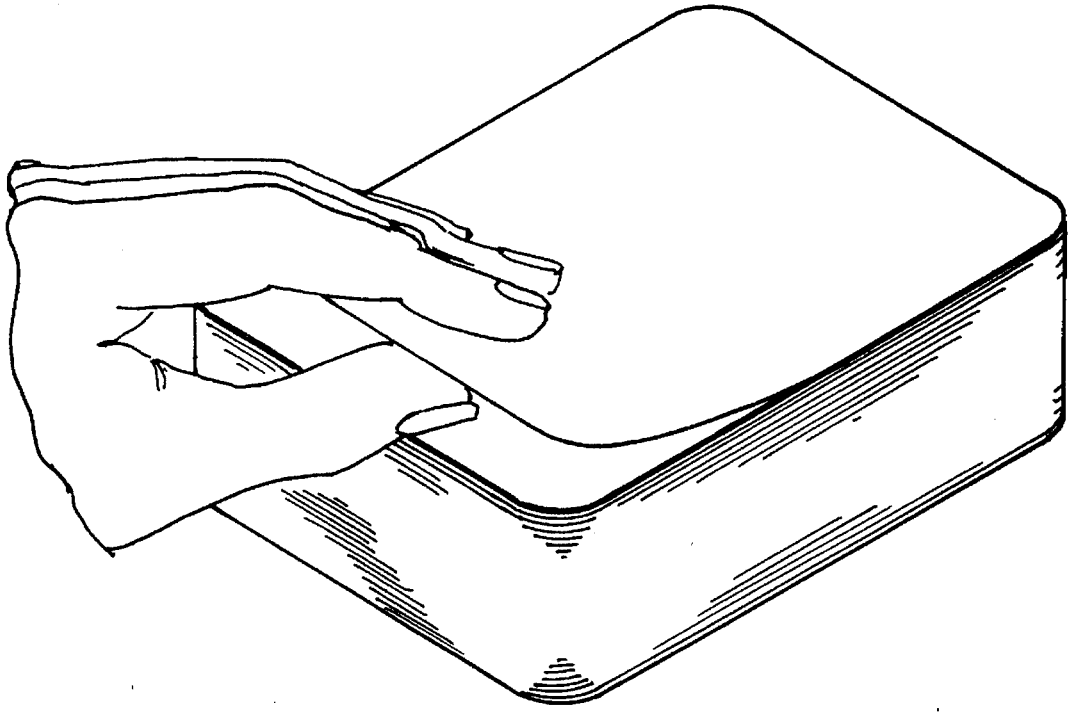

FIG. 1 is a die having a temporal indicia on at least some of the faces thereof; and FIG. 2 shows a set of cards in accordance with the invention.

DESCRIPTION OF THE INVENTION

The present invention is directed to a game of amusement, namely, a question-and-answer format quiz game having a music-related theme.

In its broadest aspects, the quiz game of the invention is based upon questions wherein a song title and year are identified and the player is requested to identify the artist that performed the song. Thus, in contrast to certain prior art games, the player is given the year and song title as clues and is asked for the artist's name, rather than being required to recite the name of the song upon hearing a segment thereof, which often proves difficult. Thus, the format of the game of the present invention enhances the player's enjoyment and success in playing the game.

In the game of the present invention, the element of chance is introduced by the players rolling a die which has temporal indicia on some or all of the surfaces thereof. The temporal indicia correspond to specific categories such as years or decades, and thus the time frame of the question posed to the player subsequent to rolling the die is not known to the player in advance. In addition to temporal categories for the questions, there may also be categories for different types of music (e.g., pop, country, R&B, etc.). This can be accomplished by having a single music theme for each game, or by having different music categories as a part of the same game which are randomly selected by rolling a "category" die.

In one embodiment of the invention, which is designed to be played "at home" as opposed to in a broadcast or live performance setting, the method of playing the music quiz game includes initially selecting at least two teams each consisting of at least one player. During play of the game there is an "answering" team and a "questioning" team, with the teams alternating roles as the questioning and answering team. A player from the answering team rolls a die which has the described temporal indicia on some or all of the faces. The temporal indicia may be a specific year or range of years such as a decade (i.e., the 50's, 60's, 70's, 80's, 90's, etc.). Thereafter, a member of the questioning team selects a card from a set of cards and states the title and year of the listed song which corresponds to the temporal category showing on the die. A player from the answering team must then identify the correct artist of the song within a predetermined time period. If the correct answer is given in a timely manner, the answering team scores a point. Play is over upon the first team to reach a predetermined number of points, such as ten, who are then declared the game winners.

An alternative embodiment of the present invention is designed to be played in a broadcast (i.e., radio or television) or live performance format and thus has some differences with respect to the "at home" embodiment described hereinabove. More particularly, in this embodiment, a pool of players is selected. A first player from the pool rolls a die with the temporal indicia on some or all of the faces thereof. As described, the temporal indicia may be specific years or ranges of years such as decades. Thereafter, a game host or moderator states a song title and year corresponding to the temporal indicia shown on the die. The player is then required to identify the correct artist for the named song within a preselected time period, such as twenty seconds. If the player gives the correct answer in a timely manner then he or she remains in the pool; however, if a wrong answer is given, the player is out of the pool. The above steps are repeated sequentially for each player in the pool, as in a spelling bee, and play continues until there is only a predetermined number of players remaining in the pool, such as three. These players are then declared game winners and may collect a prize or be given the opportunity to draw for prize money or other merchandise-type prizes.

It will be appreciated by persons skilled in the art that variations in the method of playing the game of the present invention may be made without departing from the spirit and scope thereof, as defined by the appended claims.

What is claimed is:

1. A method of playing a music quiz game of amusement, comprising the steps of:

selecting at least two teams consisting of at least one player per team, a first team being the answering team and a second team being the questioning team;

a player from said answering team rolling a die having temporal indicia on at least some of the faces thereof;

a player from said questioning team selecting a card from a set of cards and posing a question to said answering team player requesting said answering team player to identify the artist of a song identified on said card by title and year, said year corresponding to the temporal category showing on the die rolled by said answering team player;

said answering team player responding within a predetermined time period to said question by attempting to identify the correct song artist.

2. The method of claim 1 wherein said temporal indicia on said die faces are selected from the group consisting of specific years or ranges of years.

3. The method of claim 2 wherein said temporal indicia are decades.

4. The method of claim 1 wherein said first team and second team alternate rolls as questioning and answering teams.

5. The method of claim 1 wherein said answering team player scores a point for correctly identifying the song artist within said predetermined time period.

6. The method of claim 5 wherein said predetermined time period is about 20–30 seconds.

7. The method of claim 6 wherein said game is terminated upon one of said teams reaching a predetermined number of points, said team being declared the game winner.

8. A method of playing a music quiz game of amusement, comprising the steps of:

a) selecting a pool of players;

b) a first player from said pool rolling a die having temporal indicia on at least some of the faces thereof;

c) a game host posing a question to said player requesting said player to identify the artist of a song identified by title and year, said year corresponding to the temporal indicia shown on the die rolled by said player;

d) said player responding to said question within a predetermined time period by attempting to identify the correct song artist;

said steps a) through d) being repeated in sequence for each player in said pool.

9. The method of claim 8 wherein said player remains in said pool upon correctly identifying the song artist within said predetermined time period and wherein said player is dismissed from said pool upon failing to correctly identify the song artist within said predetermined time period.

10. The method of claim 9 wherein said game continues until a predetermined number of players remain in the pool, whereupon said players are declared game winners.

11. The method of claim 9 wherein said predetermined time period is about 20–30 seconds.

* * * * *